US007907743B2

(12) United States Patent
Izuchi et al.

(10) Patent No.: US 7,907,743 B2
(45) Date of Patent: Mar. 15, 2011

(54) ELECTRO-ACOUSTIC TRANSDUCER

(75) Inventors: Toshiro Izuchi, Fukuoka (JP); Kazuo Ono, Fukuoka (JP); Kensuke Nakanishi, Fukuoka (JP); Hiroaki Onishi, Fukuoka (JP); Ryuji Awamura, Fukuoka (JP)

(73) Assignee: Hosiden Corporation, Osaka (JP)

( * ) Notice: Subject to any disclaimer, the term of this patent is extended or adjusted under 35 U.S.C. 154(b) by 1315 days.

(21) Appl. No.: 11/449,908

(22) Filed: Jun. 8, 2006

(65) Prior Publication Data

US 2006/0285707 A1 Dec. 21, 2006

(30) Foreign Application Priority Data

Jun. 20, 2005 (JP) ..... 2005-179168
May 24, 2006 (JP) ..... 2006-144089

(51) Int. Cl.
*H04R 25/00* (2006.01)

(52) U.S. Cl. ..... 381/174; 381/191; 381/369; 381/355

(58) Field of Classification Search ..... 381/174, 381/355, 369, 113, 398, 399, 191, 175
See application file for complete search history.

(56) References Cited

U.S. PATENT DOCUMENTS

| | | | | |
|---|---|---|---|---|
| 5,097,515 | A * | 3/1992 | Baba | 381/191 |
| 5,272,758 | A * | 12/1993 | Isogami et al. | 381/191 |
| 7,269,268 | B2 | 6/2005 | Song et al. | |
| 2005/0123155 | A1 * | 6/2005 | Song et al. | 381/174 |
| 2008/0273736 | A1 * | 11/2008 | Pavlovic et al. | 381/369 |

FOREIGN PATENT DOCUMENTS

| | | |
|---|---|---|
| CN | 1625299 | 6/2005 |
| EP | 1 538 872 | 6/2005 |
| EP | 06 012 395.7 | 10/2007 |
| JP | 2002-191087 | 7/2002 |
| JP | 2003-153392 | 5/2003 |

OTHER PUBLICATIONS

Japanese Patent Office, Application No. JP 2006-144089, Notification of Reason(s) for Refusal, dated Mar. 4, 2008.
First Office Action issued on Nov. 12, 2010 by the Chinese Intellectual Property Office for counterpart foreign patent application CN 200610093849.3.

* cited by examiner

*Primary Examiner* — Suhan Ni
*Assistant Examiner* — Jasmine Pritchard
(74) *Attorney, Agent, or Firm* — David N. Lathrop

(57) ABSTRACT

An object of the present invention is to provide an electro-acoustic transducer having the effects of absorbing vibration and high-frequency noise, reducing the number of components, and preventing heat conduction at the same time. An electro-acoustic transducer according to the present invention includes: an electrically conductive capsule having an opening for electrically connecting internal circuitry to an external object; terminals which protrude from the opening to the outside; and a raised part which is a portion of the capsule on the opening side and is spaced with a gap from the internal structure of the capsule. The raised part and the terminals are arranged in such a manner that the raised part and all of the terminals are able to be directly soldered to a wiring board. The raised part may extend toward the terminals in such a manner that the opening is narrowed. Furthermore, the raised part may have a slit extending to the boundary between the raised part and the other part of the capsule.

10 Claims, 13 Drawing Sheets

PRIOR ART

PRIOR ART

PRIOR ART

ELECTRO-ACOUSTIC TRANSDUCER

TECHNICAL FIELD

The present invention relates to an electro-acoustic transducer such as a microphone and, in particular, to an electro-acoustic transducer that is soldered using the surface mounting art using a reflow furnace, wherein the transducer's cylindrical capsule itself functions as a ground electrode.

BACKGROUND ART

In conventional microphones, a diaphragm ring, a diaphragm, a spacer, a back electrode, a holder, a gate ring, and a substrate, for example, are stacked in a cylindrical metal capsule having sound apertures and the components are fixed by caulking the end of the capsule toward the substrate (Japanese Patent Application Laid Open No. 2003-153392 (Patent Reference 1)). Electrodes are protruded from the substrate for conduction of electricity with an external object. The caulked part has a rounded portion (prominent portion) and the extent to which the portion is rounded (the height of the prominence) varies. That is, the amount of the protrusion of the electrodes with respect to the caulked part varies. Therefore, when such a microphone is soldered using a reflow furnace, the unevenness causes poor soldering in the reflow furnace or a faulty posture (tilt) of the microphone mounted on a wiring board.

To solve the problem, the applicant has previously proposed a structure in which the disposition of components in the cylindrical metal capsule is reversed (Japanese Patent Application No. 2005-121051 filed on Apr. 19, 2005). FIG. 1 shows a cross-sectional view of the microphone previously proposed by the applicant. According to the related art, a ground electrode pattern 114 is formed on the side (bottom 121) in which opening 123 of a capsule 102 is provided. A built-in substrate 112 is provided on the ground electrode pattern 114. The built-in substrate 112 has an output terminal electrode 111 and ground terminal electrode 115 on the same side on which the ground electrode 114 is provided. The terminal electrodes 111, 115 are longer than the thickness of the capsule 102 and protrude outward through the opening 123 of the capsule 102. A conductor pattern 109 is formed on the upper surface of the built-in substrate 112 and an electronic circuit 110 is provided on it. Stacked on the upper surface of the built-in substrate 112 are a gate ring 108, a holder 107, a back electrode 106, a spacer 105, a diaphragm 104, a diaphragm ring 103, and a top plate 130 having sound apertures 131. The end of the capsule is caulked to the top plate 130, thereby fixing each of the components as well. The top plate 130 may be made of the same metal as the capsule 102 and may have the same thickness as the capsule 102, for example.

In this microphone 100, the terminal electrodes 111, 115 can be reliably protruded with respect to the thickness of the bottom 121 without being affected by unevenness of the caulked part 113. Accordingly, defects in soldering using a reflow furnace can be prevented.

However, for example, if the microphone 100 is installed in a cell phone, the microphone 100 picks up touch noise generated when a user touches the cell phone, vibration noise generated by driving of a built-in motor and the like. This problem is unavoidable as long as the microphone is directly mounted on a wiring board.

FIG. 2 shows a circuit configuration of an analog microphone. Contained in a capsule 102 are an acoustic-electric converter 100' and an electronic circuit 110. The acoustic-electric converter 100' is formed by the capsule 102 and internal components. The electronic circuit 110 consists of a field-effect transistor (FET) and a capacitor, for example. As can be seen from FIG. 2, the microphone 100 has two terminals: an output terminal and a ground terminal. It should be noted that, the terminal electrode (ground) 115 is shown in two positions in FIG. 1 because FIG. 1 is a cross-sectional view of a toroidal terminal.

The applicant has also proposed previously, in another application, an electret condenser microphone that can be soldered using a reflow furnace and outputs a digital signal (Japanese Patent Application No. 2005-320815 filed on Nov. 14, 2005). FIG. 3 is a cross-sectional view of an exemplary electret condenser microphone outputting a digital signal proposed by the present applicant. The front type electret condenser microphone 200 has an electret polymer film made of a heat-resistant material within an electrically conductive capsule 201. An electrically conductive diaphragm 207, an electrically conductive ring 208, a gate ring 209, and a wiring substrate 202 are provided and are separated from the electret polymer film by a spacer 206 made of an heat-resistant insulator. The end of the electrically conductive capsule 201 is caulked to the wiring substrate 202 and fixes the internal components. An IC device 210 is mounted on the interior side of the wiring substrate 202. Four terminals 204(*a-d*) are provided on the exterior side of the wiring substrate 202. The terminals 204(*a-d*) are protruded through an opening 223 of the front type electret condenser microphone 200 for conduction of electricity with an external object. With this configuration, a digital electret condenser microphone capable of resisting high temperatures generated by soldering in a reflow furnace can be implemented.

FIG. 4 shows a circuit configuration of a digital microphone. Provided in an electrically conductive capsule 201 are an acoustic-electric converter 200' and an IC device 210. The acoustic-electric converter 200' is formed by the capsule 201 and internal components. The IC device 210 includes an impedance converter/amplifier 210*a* and a digital sigma modulator 210*b*. As can be seen from FIG. 4, four terminals, a power supply terminal 204*a*, a clock input terminal 204*b*, a digital data output terminal 204*c*, and a ground terminal 204*d*, are provided. A problem with this digital microphone is that it is susceptible to high-frequency noise from nearby components because its ground terminal does not have a toroidal shape.

An approach to reducing the number of components of both analog and digital microphones may be to solder the bottom of the capsule directly to a wiring board, thereby omitting the ground terminal. In this case, if a ground electrode can be formed into a toroidal shape, the microphone would be less susceptible to high-frequency noise. However, some measures must be taken against heat transferred to the interior of the microphone during soldering in a reflow furnace. Furthermore, the vibration pickup problem cannot be solved by using the bottom itself as the ground electrode.

BRIEF SUMMARY OF THE INVENTION

Thus, there are various problems with mounting an electro-acoustic transducer directly on a wiring board, and it has been impossible to solve all of those problems at the same time. An object of the present invention is to provide a structure that achieves the following four objects at the same time: a first object is to make the structure resistant to vibration from a wiring board; a second object is to make the structure resistant to high-frequency noise; a third object is to reduce the number of components, and a fourth object is to make the structure resistant to heat generated during soldering in a reflow furnace.

An electro-acoustic transducer (such as a microphone) according to the present invention includes: an electrically conductive capsule having an opening for electrically connecting internal circuitry to an external object; terminals which protrude from the opening to the outside; and a raised part which is a portion of the capsule on the opening side and is spaced with a gap from the internal structure of the capsule. The raised part and the terminals are arranged in such a manner that the raised part and all of the terminals are able to be directly soldered to a wiring board. The raised part may extend toward the terminals in such a manner that the opening is narrowed. Furthermore, the raised part may have a slit extending to the boundary between the raised part and the other part of the capsule.

According to the present invention, there is a gap between the raised part to be soldered to a wiring board and the main structure of the electro-acoustic transducer (such as a microphone). The gap makes the transducer resistive to vibration. Also, a ground electrode of the present invention may be toroidal so that it is not affected by any high-frequency noise. Furthermore, the number of components of the transducer can be reduced because the capsule itself functions as a ground electrode. Moreover, the gap between the raised part and the main structure of the electro-acoustic transducer makes the transducer resistive to heat generated during soldering in a reflow furnace.

BEST MODE FOR CARRYING OUT THE INVENTION

Figure 1:
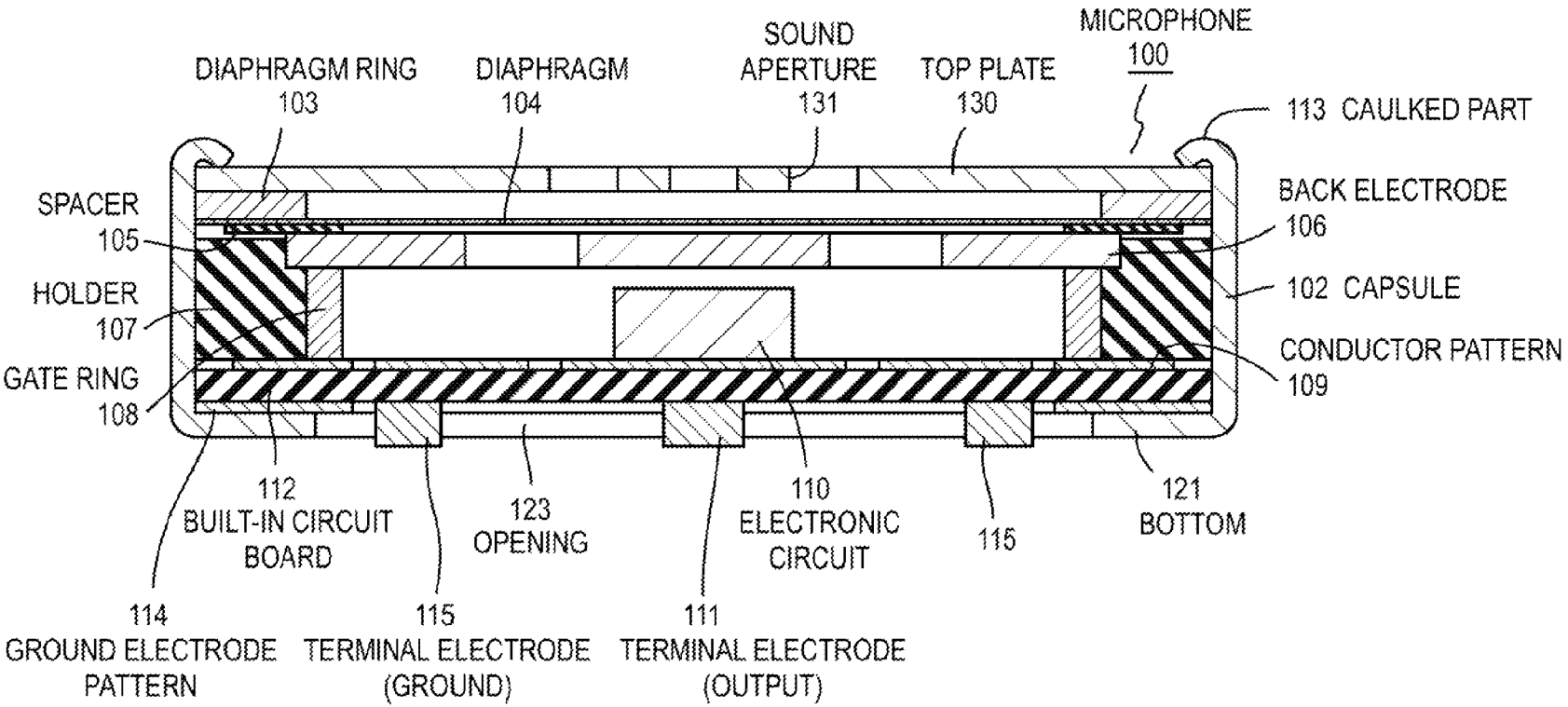
FIG. 1 shows a cross-section of a microphone previously proposed by the applicant.
Figure 2:
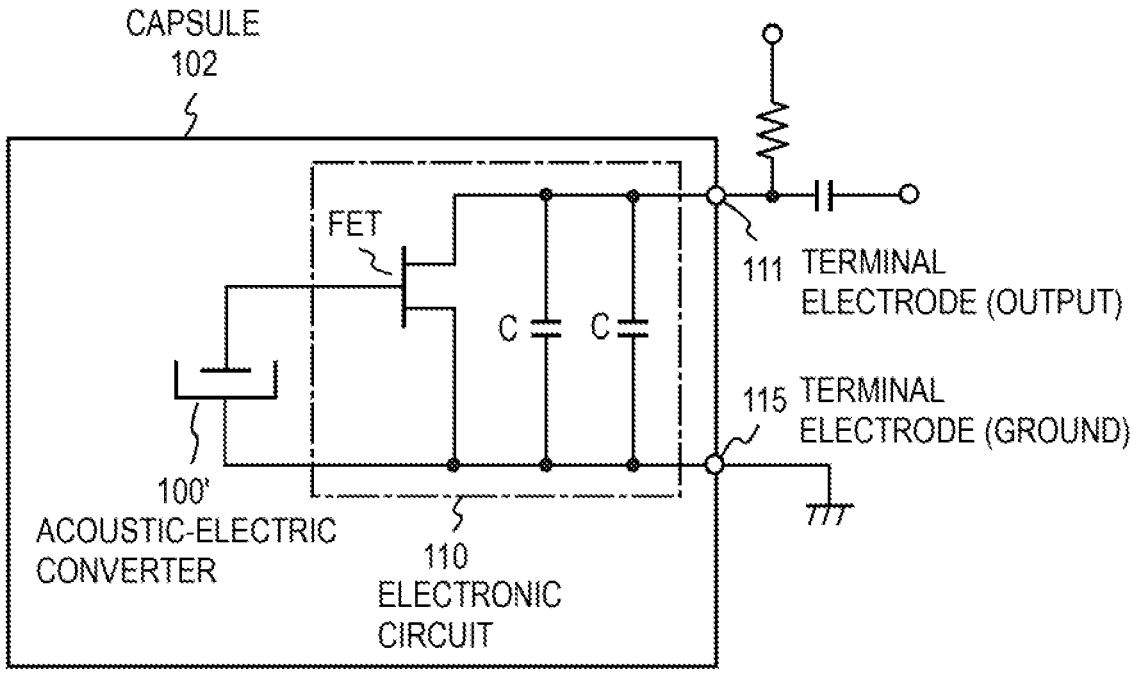
FIG. 2 PRIOR ART
FIG. 2 shows a circuit configuration of an analog microphone.

In the following description, components having like functions are labeled like reference numerals and redundant description of which will be omitted.

First Embodiment

Figure 5:
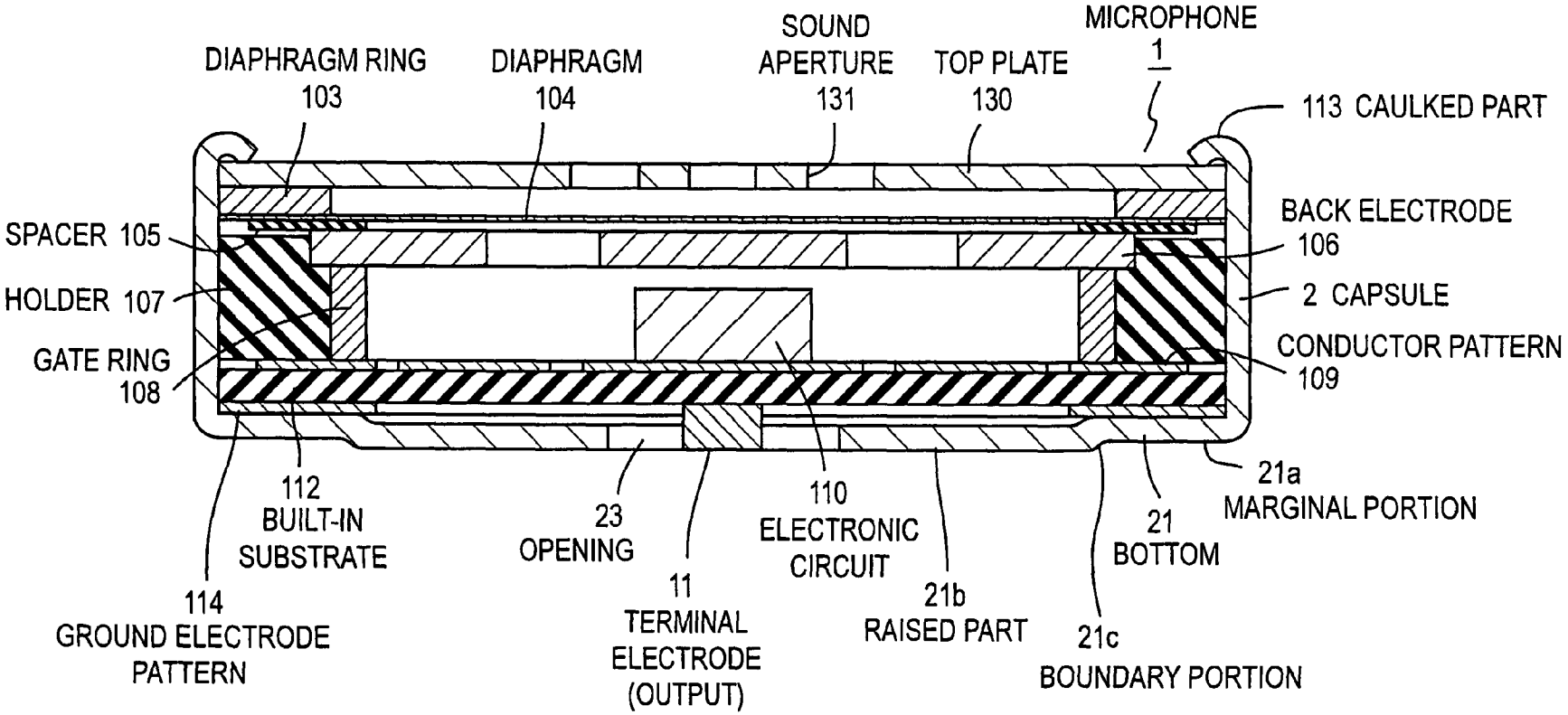
FIG. 5 is a cross-sectional view showing a structure of a microphone according to a first embodiment.

FIG. 5 is a cross-sectional view showing a structure of a microphone according to a fist embodiment. An electrically conductive capsule 2 has, on the bottom face, a bottom 21 with which internal components are in contact, an opening 23 through which a terminal electrode is exposed, and raised parts 21*b* raised from the bottom 21. The capsule 2 may be made of albata or aluminum. A built-in substrate 112 is in contact with the bottom 21. The built-in substrate 112 has a ground electrode pattern 114 electrically connected to the bottom 21, and a conductor pattern 109 provided on the side opposite to the bottom 21. A terminal electrode (output) 11 for providing electrical contact with an external object through an opening 23 is provided on the surface of the built-in substrate 112 on the bottom 21 side. An electronic circuit 110 is mounted on the surface of the built-in substrate 112 on the side opposite to the bottom 21. The terminal electrode 11 may be formed as an integral part of the built-in substrate 112 or may be formed by plating or the like on the built-in substrate 112. Stacked on the built-in substrate 112 on the side opposite to the bottom 21 are a gate ring 108, a holder 107, a back electrode 106, a spacer 105, a diaphragm 104, a diaphragm ring 103, and a top plate 130 having sound apertures 131. The end of the capsule 2 is caulked to the top plate 130, thereby fixing the internal components. The lower end of the raised part 21*b* is substantially in the same plane as the lower end of the terminal electrode (output) 11. The purpose of this is to ensure that the terminal electrode (output) 11 and the raised part 21*b* are evenly soldered when the microphone is soldered to a wiring board and that the microphone is firmly mounted on the wiring board without tilting with respect to the wiring board.

With this configuration, a gap of approximately 50 μm-100 μm is created between the raised part 21*b* and the built-in substrate 112. The size of the gap depends on the size of the microphone in practice. Because of the gap between the raised part 21*b* and the built-in substrate 112, the raised part 21*b* functions as a member that absorbs vibration from an external vibration source. Accordingly, vibration transferred to the microphone 1 can be reduced. Furthermore, because only the raised part 21*b*, rather than the entire bottom 21, is in contact with the wiring board, the contact area is reduced and therefore less vibration is transferred to the microphone 1. In addition, the gap can prevent heat conduction to the interior of the microphone even when the portion (raised part 21*b*) to be soldered is exposed to a high temperature, for example 260° C., in a reflow furnace. It should be noted that if the raised part 21*b* is reduced in length in the radial direction, heat transferred from the raised part 21*b* to the built-in substrate 112 can also be reduced because the area in contact with solder (heated area) is reduced. Furthermore, the need for the terminal electrode (ground) 115 shown in FIG. 1 can be eliminated because the raised part 21*b* functions as a ground electrode. Moreover, the raised part 21*b* can be formed into a toroidal shape, thereby resolving the high-frequency noise problem.

Figure 6:
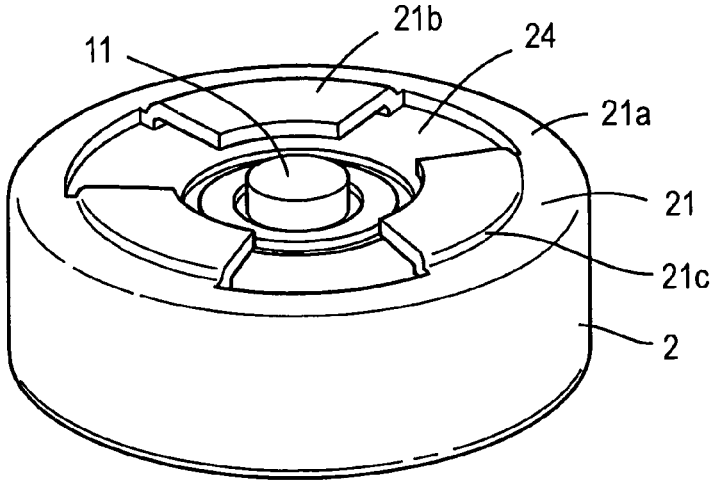
FIG. 6 is an external perspective view of the microphone 1 in FIG. 5 viewed from the bottom 21.
Figure 7:
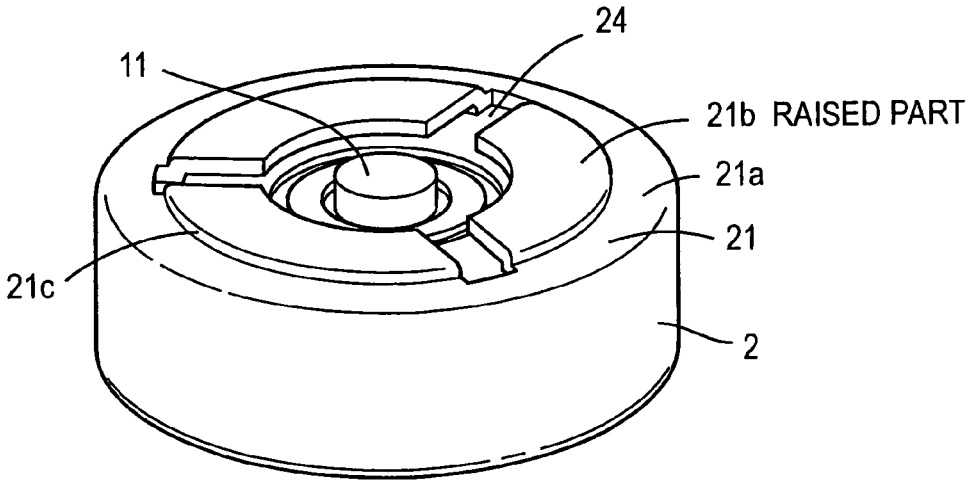
FIG. 7 is an external perspective view of the microphone 1 in FIG. 5 viewed from the bottom 21.

FIGS. 6 and 7 are perspective views of the microphone 1 shown in FIG. 5, viewed from the bottom 21. While both FIGS. 6 and 7 show examples in which the raised part 21*b* is split into three, the raised part 21*b* may be split into any other number of sections. The difference between the examples in FIGS. 6 and 7 lies in the width of the slit 24. With this configuration, the elasticity of the raised part 21*b* can be controlled by adjusting the width of the raised part 21*b*. That is, the ability of the raised part 21*b* to absorb vibration can be controlled by adjusting the number of sections into which the raised part 21*b* is split and by adjusting the width of the slit 24. Heat conduction can also be controlled by adjusting the width of the raised part 21*b*. However, if the slit 24 is too wide, the raised part 21*b* which also functions as a ground electrode would lose the shape of toroid and would become susceptible to high-frequency noise.

As has been described, the provision of the raised part 21*b* allows for the effects of absorbing vibration and high-frequency noise, reducing the number of components, and preventing heat conduction. The number of sections of the raised part 21*b*, the radial length of the raised part 21*b*, and the width of the slit 24 should be chosen to be appropriate to the environment in which the microphone 1 is used because the effects of absorbing vibration and high-frequency noise and preventing heat conduction can be in a trade-off relationship with one another.

It should be noted that the position of the terminal electrode (output) 11 does not change even if the microphone is rotated because the electrode 11 is positioned in the center of the built-in substrate 112 and the raised part 21*b* is provided around it in toroidal form. Therefore, when mounting the microphone, the microphone can be positioned in place merely by aligning the terminal electrode (output) 11. Furthermore, the slit 24 dividing the raised part 21*b* extends to the boundary 21*c* between the raised part 21*b* and a marginal portion 21*a*. Accordingly, the opening is not completely sealed when the microphone is soldered on a wiring board. That is, the slit 24 at the boundary 21*c* let the gas escape during soldering. The slit 24 must have a sufficient width for releasing gas.

Second Embodiment

Figure 3:
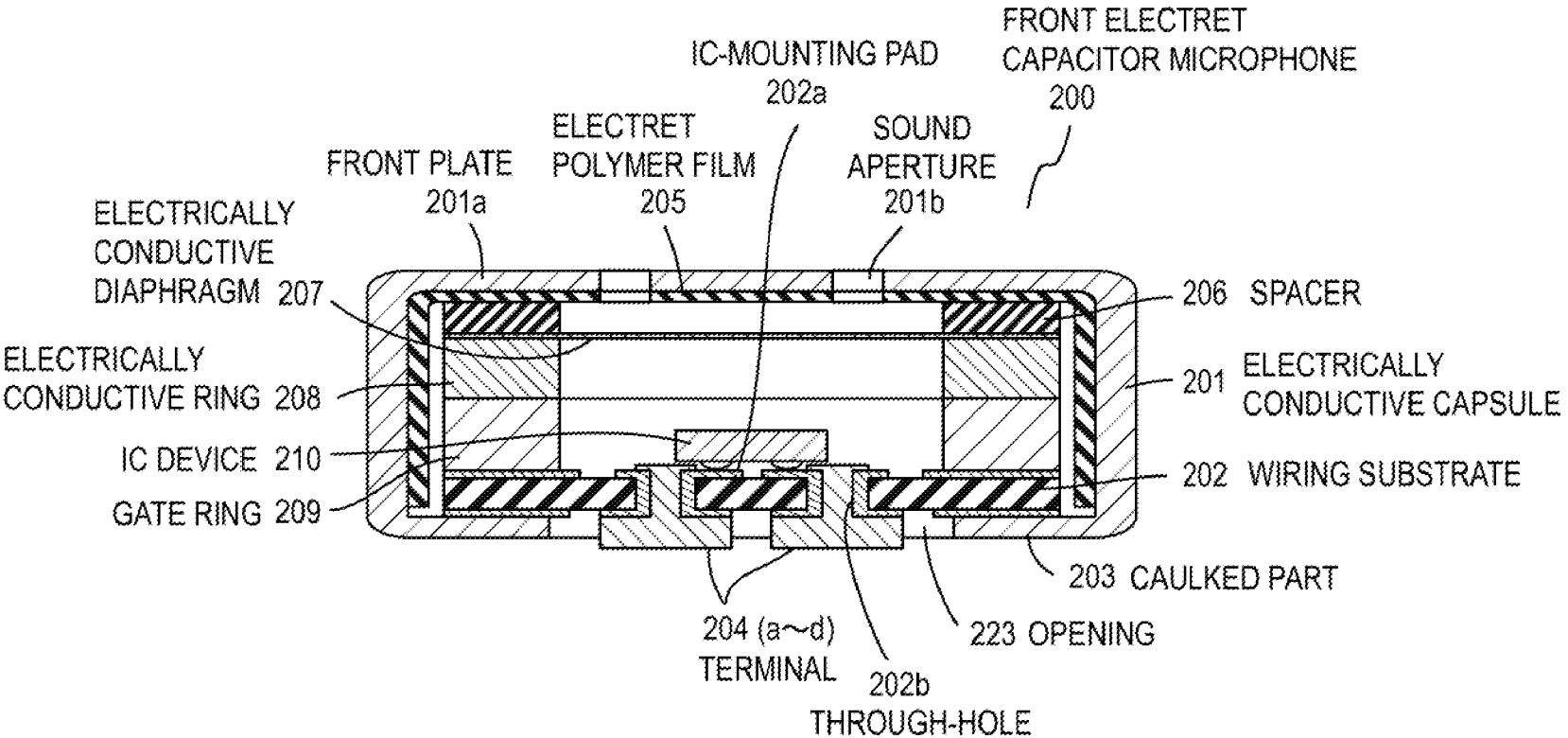
FIG. 3 is a cross-sectional view of an exemplary electret condenser microphone outputting a digital signal proposed previously by the applicant.
Figure 4:
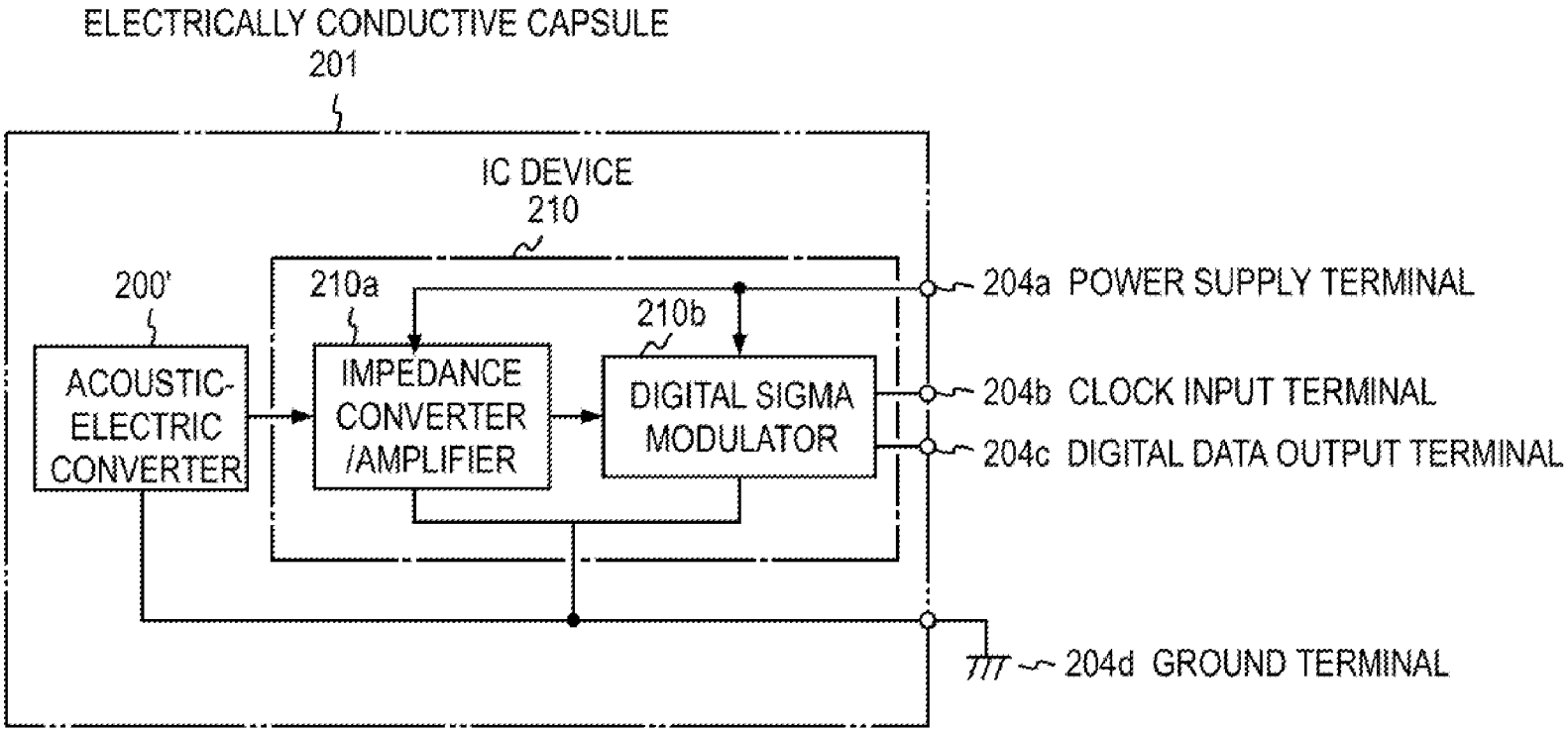
FIG. 4 shows a circuit configuration of a digital microphone.
Figure 8:
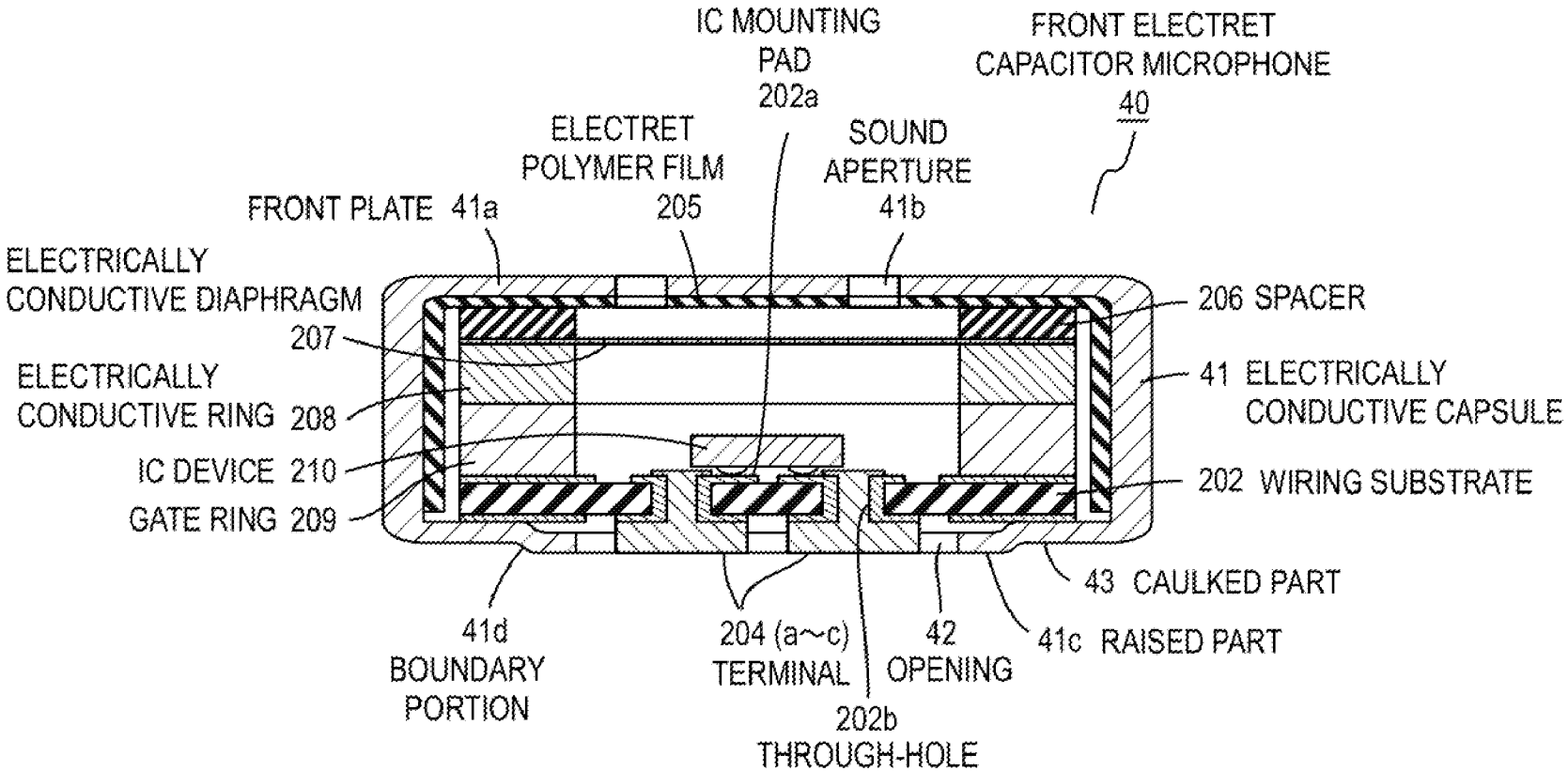
FIG. 8 is a cross-sectional view of a digital front type electret condenser microphone to which the present invention is applied.

FIG. 8 is a cross-sectional view of a digital front type electret condenser microphone to which the present invention is applied. The differences of the microphone in FIG. 8 from that in FIG. 3 lie in the shape of the electrically conductive capsule and the number of the terminals 204. The electrically conductive capsule 41 of the present invention has a raised part 41*c* on the opening 42 side. Accordingly, a caulked part 43 is not an end of the electrically conductive capsule 41. The raised part 41*c* acts as a ground terminal and therefore eliminates the need for the ground terminal 204*d* shown in FIG. 3.

Figure 9:
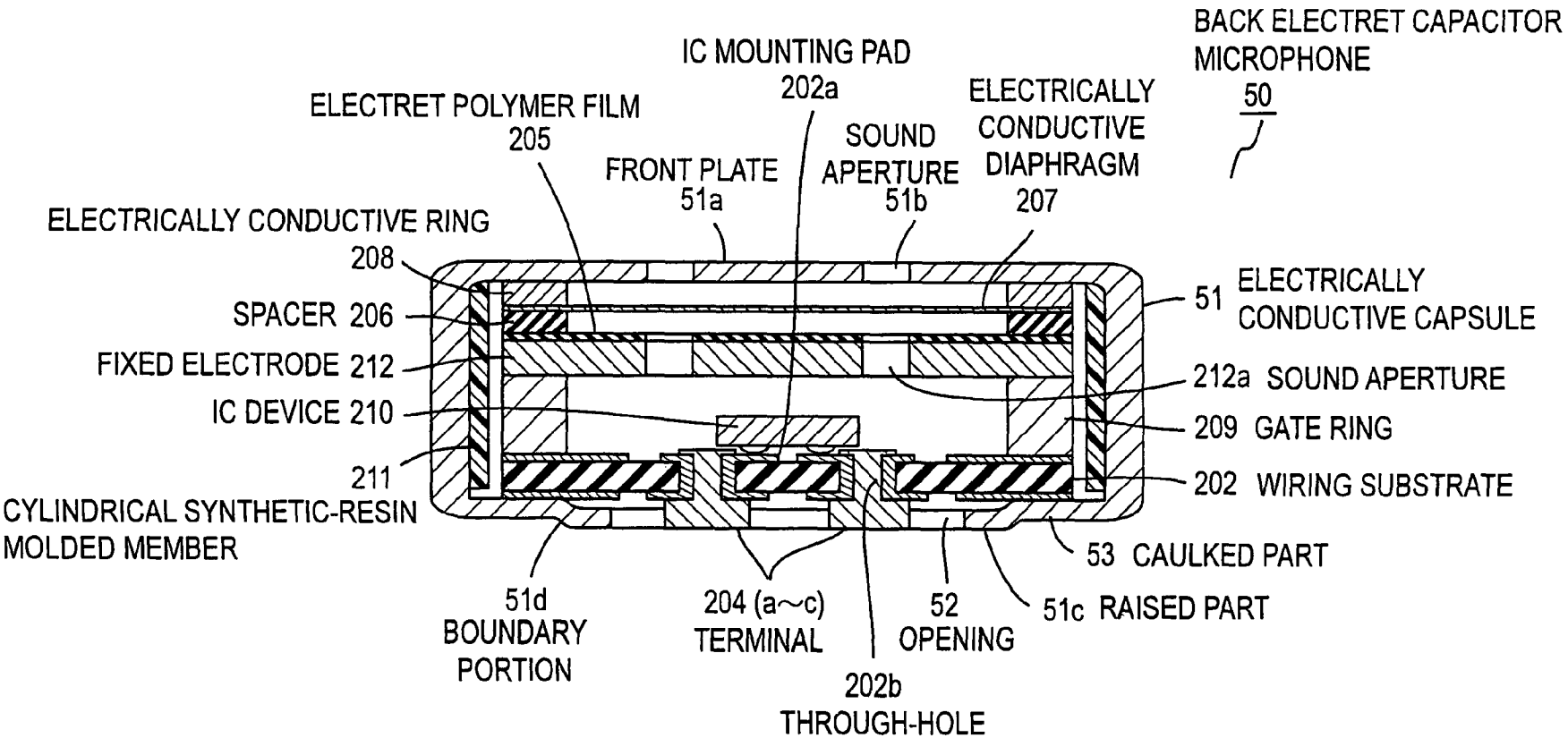
FIG. 9 is a cross-sectional view of a digital back type electret condenser microphone to which the present invention is applied.

FIG. 9 is a cross-sectional view of a digital back type electret condenser microphone to which the present invention is applied. The electrically conductive capsule 51 has a raised part 51*c* on the opening 52 side. A heat-resistive cylindrical synthetic-resin molded member 211 is provided on the internal sidewall of the electrically conductive capsule 51. Stacked inside the electrically conductive capsule 51 are a front plate 51*a*, an electrically conductive ring 208, an electrically conductive diaphragm 207, a spacer 206, an electret polymer film 205, a fixed electrode 212 having sound apertures 212*a*, a gate ring 209, and a wiring substrate 202 having an IC device 210 and terminals 204*a*-204*c*, in this order.

Figure 10:
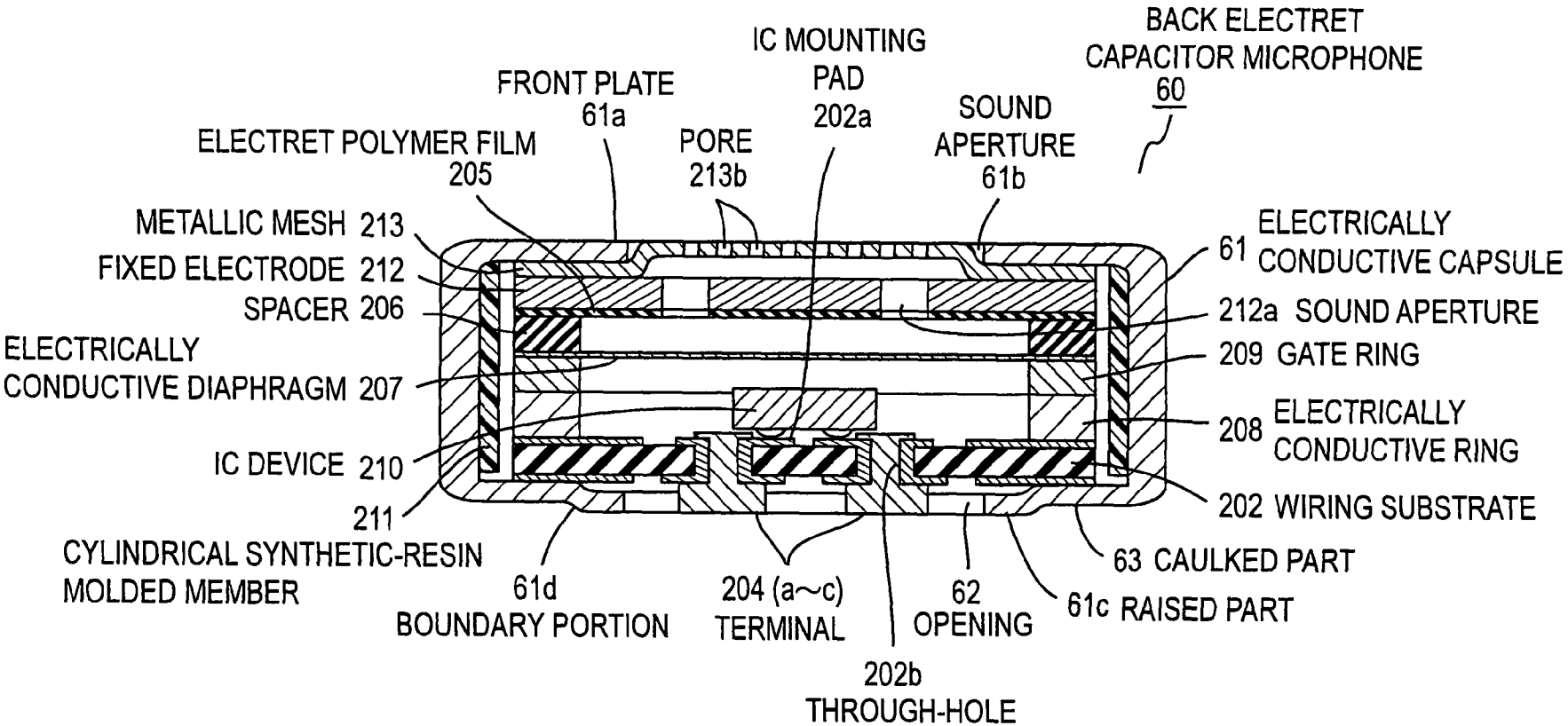
FIG. 10 is a cross-sectional view of another digital back type electret condenser microphone to which the present invention is applied.

FIG. 10 is a cross-sectional view of another digital back type electret condenser microphone to which the present invention is applied. The electrically conductive capsule 61 has a raised part 61*c* on the opening 62 side. A heat-resistive cylindrical synthetic-resin molded member 211 is provided on the internal sidewall of the electrically conductive capsule 61. Stacked inside the electrically conductive capsule 61 are a front plate 61*a*, a dust-preventive metallic mesh 213 having pores 213*b*, a fixed electrode 212 having sound apertures 212*a*, an electret polymer film 205, a spacer 206, an electrically conductive diaphragm 207, a gate ring 209, an electrically conductive ring 208, and a wiring substrate 202 having an IC device 210 and terminals 204*a*-204*c*, in this order.

Figure 11:
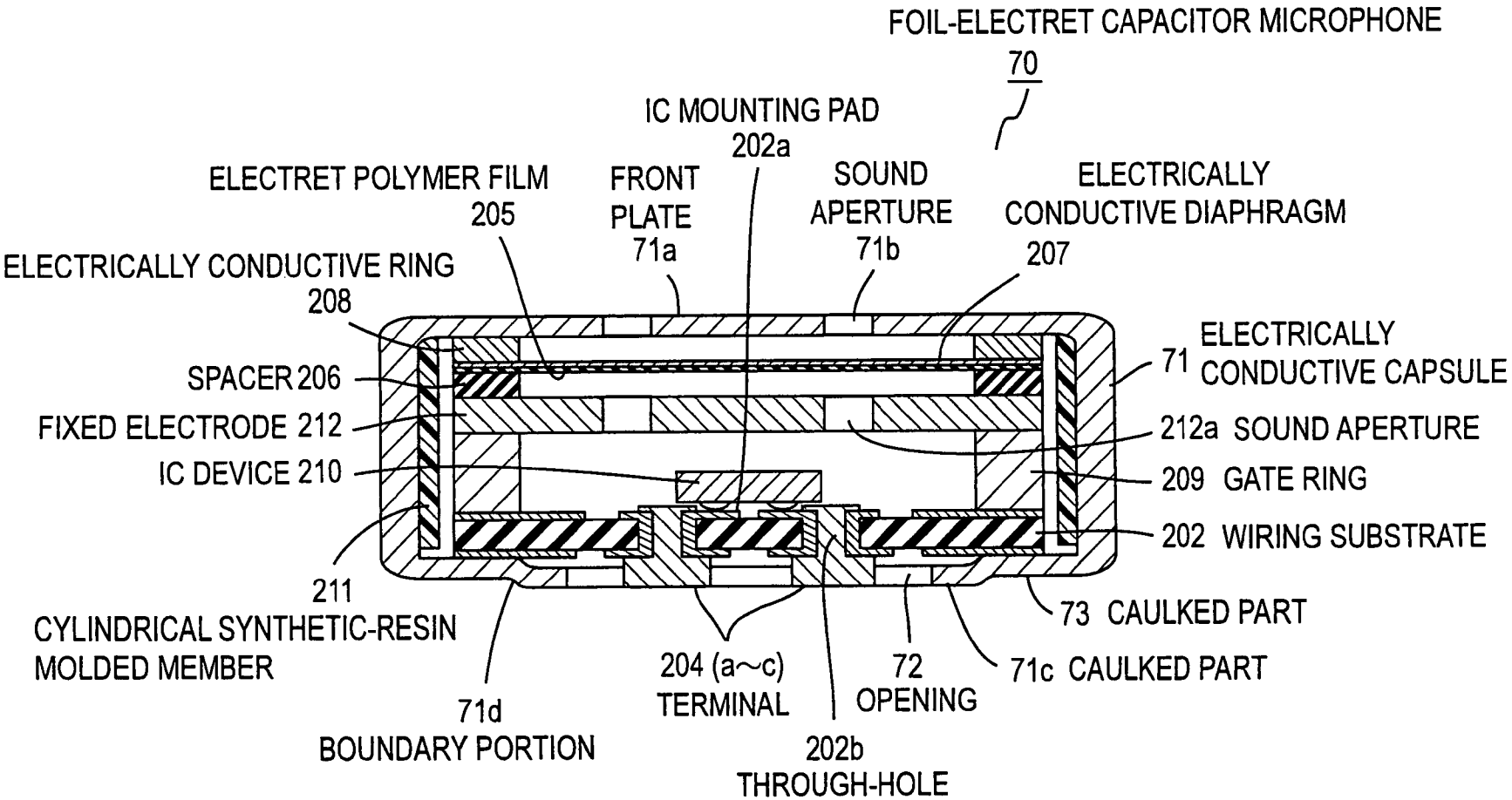
FIG. 11 is a cross-sectional view of a digital foil type electret condenser microphone to which the present invention is applied.

FIG. 11 is a cross-sectional view of a digital foil type electret condenser microphone to which the present invention is applied. The electrically conductive capsule 71 has a raised potion 71*c* on the opening 72 side. A heat-resistive cylindrical synthetic-resin molded member 211 is provided on the internal sidewall of the electrically conductive capsule 71. Stacked inside the electrically conductive capsule 71 are a front plate 71*a*, an electrically conductive ring 208, an electrically conductive diaphragm 207, a spacer 206, a fixed electrode 212 having sound apertures 212*a*, a gate ring 209, and a wiring substrate 202 having an IC device 210 and terminals 204*a*-204*c*, in this order.

Figure 12A:
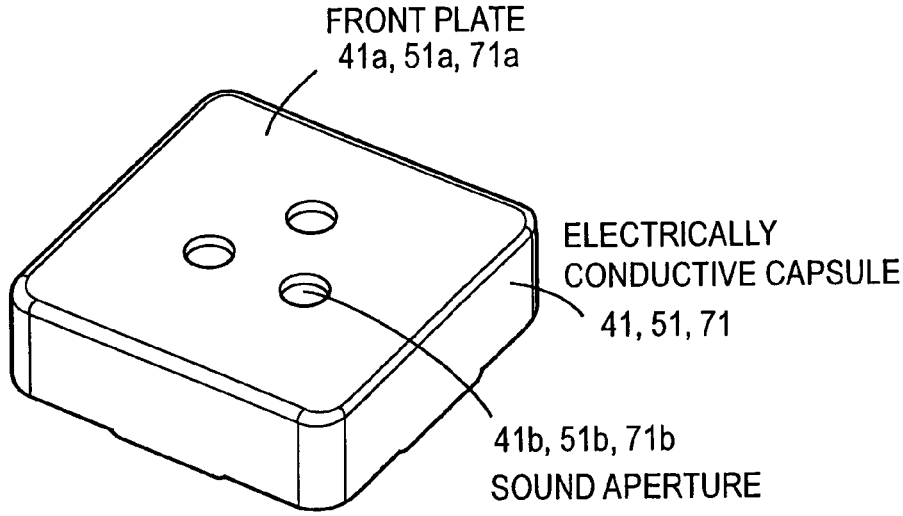
FIG. 12A is an external perspective view of a digital electret condenser microphone having a front plate with three small sound apertures, viewed from the front-plate side.
Figure 12B:
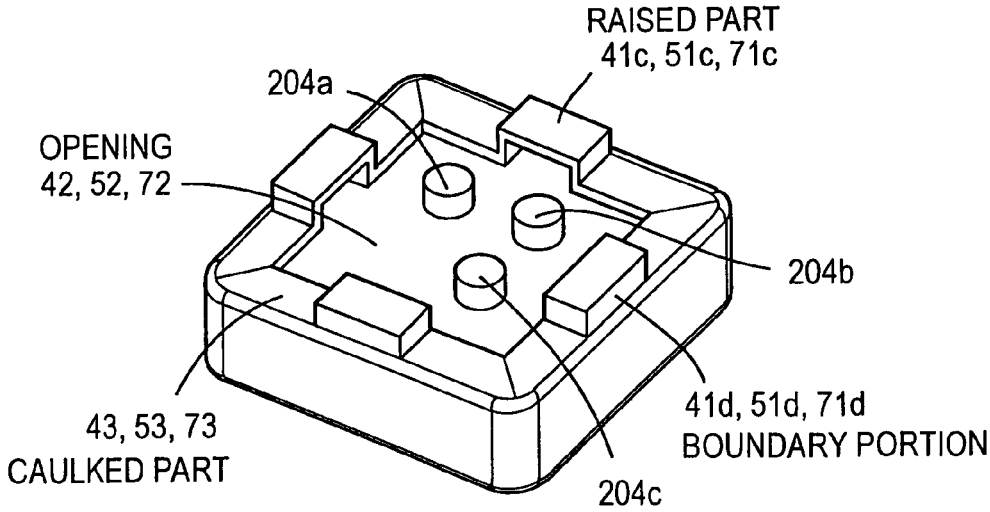
FIG. 12B is an external perspective view of a digital electret condenser microphone having a raised part raised near a caulked part, viewed from the opening side.
Figure 13A:
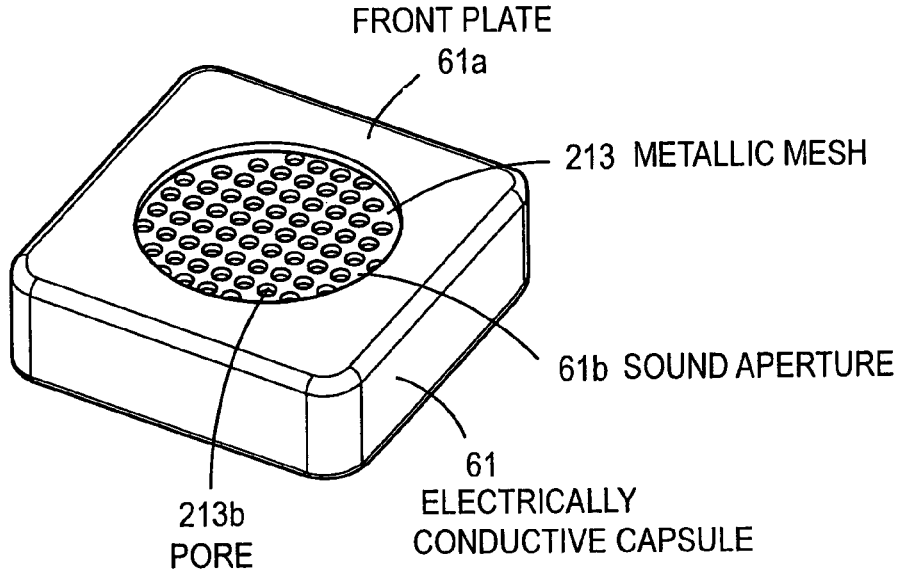
FIG. 13A is an external perspective view of a digital electret condenser microphone having a front plate with a large circular sound aperture, viewed from the front-plate side.
Figure 13B:
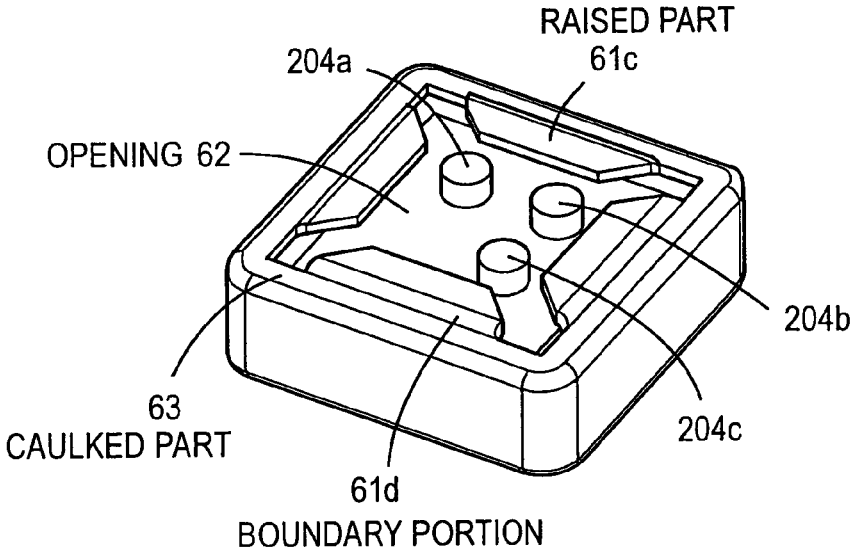
FIG. 13B is an external perspective view of a digital electret condenser microphone having a raised part extending toward terminals to narrow the opening, viewed from the opening side.
Figure 14A:
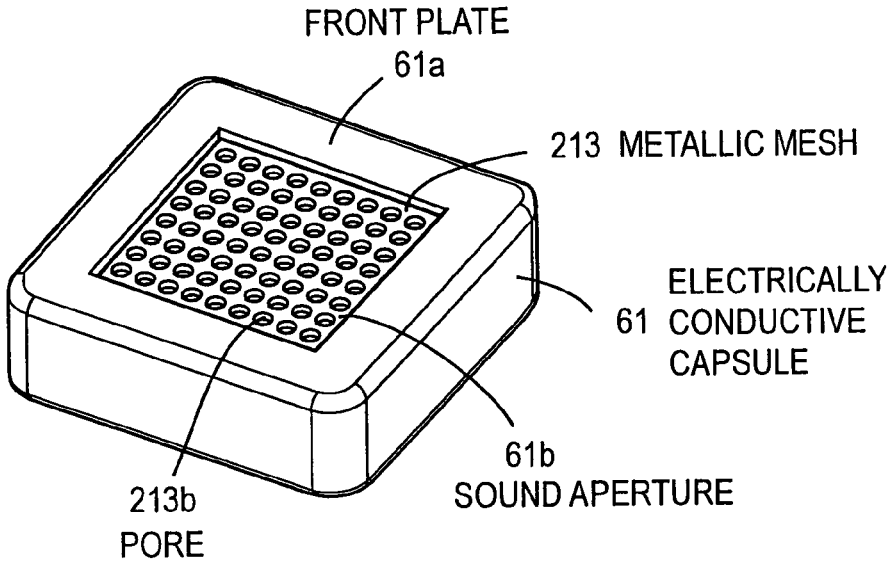
FIG. 14A is an external perspective view of a digital electret condenser microphone having a front plate with a large square sound aperture, viewed from the front-plate side.
Figure 14B:
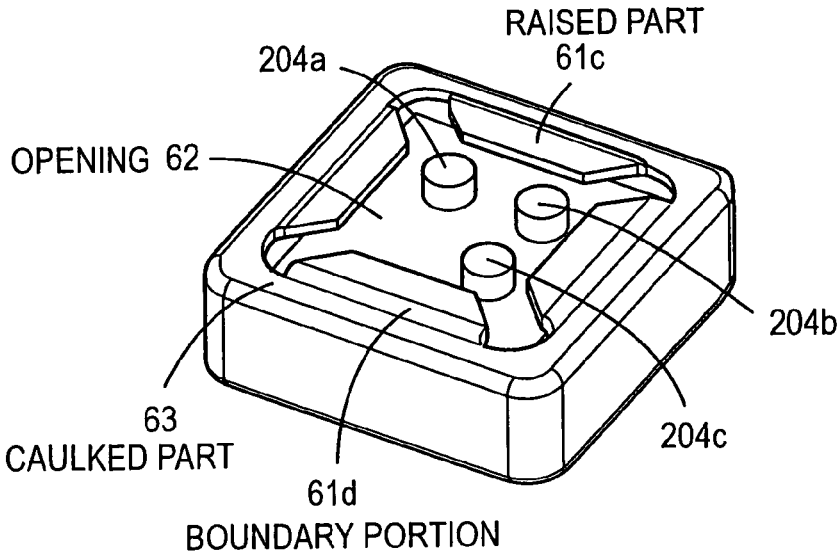
FIG. 14B is an external perspective view of a digital electret condenser microphone having a raised part extending toward terminals to narrow the opening, viewed from the opening side.

FIGS. 12A, 13A, and 14A are external perspective view of digital electret condenser microphones viewed from their front-plate side. FIG. 12A shows a microphone with a front plate 41*a*, 51*a*, 71*a* having three small sound apertures 41*b*, 51*b*, 71*b*. FIG. 13A shows a microphone with a front plate 61*a* having a large circular sound aperture 61*b*. FIG. 14A shows a microphone with a front plate 61*a* having a large square sound aperture 61*b*. FIGS. 12B, 13B, and 14B are external perspective view of the digital electret condenser microphones viewed from the opening side. The digital electret condenser microphones have only three terminals, a power supply terminal 204, a clock input terminal 204*b*, and a digital data output terminal 204*c*, because their raised part 41*c*, 51*c*, 61*c*, 71*c* also functions as a ground terminal. In FIG. 12B, the raised part 41*c*, 51*c*, 71*c* is raised near the caulked part 43, 53, 73. The internal structure may be any of the structures shown in FIGS. 8, 9, and 11. In FIGS. 13B and 14B, the raised part 61*c* extends toward the terminals to narrow the opening 62. The internal structure is as shown in FIG. 10. Microphones having the structures shown in FIGS. 8, 9, and 11 also can be modified to have any of the exterior appearances shown in FIGS. 13A and 14A by attaching a metallic mesh 213 on the front plate 41*a*, 51*a*, 71*a*. While the front plate of the three microphones is generally square, it may be a circle as shown in FIGS. 6 and 7.

The height of the raised parts 41*c*, 51*c*, 61*c*, 71*c* is substantially the same as the height of the protruded portion of the terminals 204*a*-204*c*. The purpose of this is to ensure that the terminals 204*a*-204*c* and the raised part 41*c*, 51*c*, 61*c*, 71*c* are evenly soldered when the microphone is soldered to a wiring board and that the microphone is firmly mounted on the wiring board without tilting with respect to the wiring board.

With this configuration, a gap of approximately 50 μm-100 μm is created between the raised part 41$c$, 51$c$, 61$c$, 71$c$ and the wiring substrate 202. The size of the gap depends on the size of the microphone in practice. Because of the gap, the raised part 41$c$, 51$c$, 61$c$, 71$c$ functions as a member that absorbs vibration from an external vibration source. Accordingly, vibration transferred to the electret condenser microphone 40, 50, 60, 70 can be reduced. In addition, the gap can prevent heat conduction to the interior of the microphone even when the portion (raised part 41$c$, 51$c$, 61$c$, 71$c$) to be soldered is exposed to a high temperature, for example 260° C., in a reflow furnace. It should be noted that if the area of the raised part is reduced, heat transferred to the wiring substrate 202 can also be reduced because the area in contact with solder (heated area) is reduced. Furthermore, because the raised part 41$c$, 51$c$, 61$c$, 71$c$ surrounds the terminals 204$a$-204$c$, the high-frequency noise problem is eliminated.

In addition, the elasticity and heat conduction of the raised part can be controlled by adjusting the width of the raised part 41$c$, 51$c$, 61$c$, 71$c$. However, if the width of the raised part 41$c$, 51$c$, 61$c$, 71$c$ is too small, the raised part would no longer surround the terminals and the microphone would become susceptible to high-frequency noise.

As has been described, the provision of the raised part 41$c$, 51$c$, 61$c$, 71$c$ allows for the effects of absorbing vibration and high-frequency noise, reducing the number of components, and preventing heat conduction. The width of the raised part 41$c$, 51$c$, 61$c$, 71$c$ and the length of its extension toward the terminals should be chosen to be appropriate to the environment in which the microphone is used because the effects of absorbing vibration and high-frequency noise and preventing heat conduction can be in a trade-off relationship with one another.

What is claimed is:

1. An electro-acoustic transducer comprising:

an electrically conductive capsule having internal circuitry and an opening for electrically connecting the internal circuitry to an external object;

terminals which protrude from the opening for electrically connecting the internal circuitry to the external object; and a raised part of the capsule with an end adjacent to the opening that is spaced with a gap from the internal circuitry.

2. The electro-acoustic transducer according to claim 1, wherein the raised part and the terminals are arranged in such a manner that the raised part and all of the terminals are able to be directly soldered to a wiring board.

3. The electro-acoustic transducer according to claim 2, wherein the raised part extends toward the terminals in such a manner that the opening is narrowed.

4. The electro-acoustic transducer according to claim 3, wherein the raised part has a slit which prevents the opening from being sealed when the raised part is directly soldered to a wiring board.

5. The electro-acoustic transducer according to any of claims 1 to 4, wherein the capsule has a caulked part on the side opposite to the side in which the opening is provided, the caulked part fixing internal circuitry.

6. The electro-acoustic transducer according to claim 1 or 2, comprising:

an electret polymer film made of a heat-resistive material; and a spacer which provides a gap between the side opposite to the side in which the opening is provided and the internal circuitry and is made of a heat-resistive material.

7. The electro-acoustic transducer according to claim 1, wherein the end of the raised part is free to vibrate so as to absorb vibrations from an external vibration source.

8. The electro-acoustic transducer according to claim 1 that comprises:

a plate attached to the electrically conductive capsule; and sound apertures formed in the plate.

9. The electro-acoustic transducer according to claim 1 that comprises sound apertures formed in a surface of the electrically conductive capsule that is displaced from the raised part of the capsule.

10. The electro-acoustic transducer according to claim 1 that comprises sound apertures formed in a surface of the electrically conductive capsule that is opposite to the raised part of the capsule.

* * * * *